US005348302A

United States Patent [19]

Sasamoto et al.

[11] Patent Number: 5,348,302

[45] Date of Patent: Sep. 20, 1994

[54] GOLF CLUB HEAD

[75] Inventors: Akinori Sasamoto; Yuichi Aizawa, both of Tokyo, Japan

[73] Assignee: Daiwa Golf Co., Ltd., Tokyo, Japan

[21] Appl. No.: 983,737

[22] Filed: Dec. 1, 1992

[30] Foreign Application Priority Data

Dec. 9, 1991 [JP] Japan ..... 3-101146[U]

[51] Int. Cl.[5] ..... A63B 53/04

[52] U.S. Cl. ..... 273/169; 273/167 H; 273/DIG. 23

[58] Field of Search ..... 273/167 R, 77 A, DIG. 23

[56] References Cited

U.S. PATENT DOCUMENTS

| | | | |
|---|---|---|---|
| 3,211,455 | 10/1965 | Hyden | 273/173 X |
| 4,438,931 | 3/1984 | Motomiya | 273/167 H |
| 4,523,759 | 6/1985 | Igarashi | 273/169 |
| 4,728,105 | 3/1988 | Kobayashi | 273/169 |
| 4,792,139 | 12/1988 | Nagasaki et al. | 273/167 H |
| 4,793,616 | 12/1988 | Fernandez | 273/167 H |
| 4,890,840 | 1/1990 | Kobayashi | 273/167 H |
| 4,928,972 | 5/1990 | Nakanishi et al. | 273/167 H X |
| 5,007,643 | 4/1991 | Okumoto et al. | 273/167 R |
| 5,009,425 | 4/1991 | Okumoto et al. | 273/167 R |
| 5,135,227 | 8/1992 | Okumoto et al. | 273/167 R |
| 5,184,823 | 2/1993 | Desbiolles et al. | 273/167 H X |

FOREIGN PATENT DOCUMENTS

| | | | |
|---|---|---|---|
| 60-49868 | 4/1985 | Japan . | |
| 61-139256 | 8/1986 | Japan . | |
| 323897 | 1/1930 | United Kingdom | 273/167 R |

*Primary Examiner*—Vincent Millin
*Assistant Examiner*—Sebastiano Passaniti
*Attorney, Agent, or Firm*—Longacre & White

[57] ABSTRACT

A golf club head includes: a hosel portion for connection with a shaft; and a base metal body formed integrally with the hosel portion by a metal material so as to continue to the hosel portion, the base metal body being constituted by a sole portion, a top portion and a space portion formed between the sole portion and the top portion and filled with a filling member, the sole portion and the top portion being formed so as to be substantially equal in weight to each other, the space portion being placed in a sweet-spot corresponding position so that the space portion corresponds to a sweet spot, the filling member being formed by a material smaller in specific gravity than the base metal body.

14 Claims, 5 Drawing Sheets

GOLF CLUB HEAD

BACKGROUND OF THE INVENTION

The present invention relates a golf club head, and particularly relates to an improvement of a golf club head.

Generally, a head of an iron club is integrally made of a metal material such as soft iron, brass, stainless steel, or the like.

A golf club head of this kind has a shape and weight which are made to correspond to each club number. Being a mass of metal, however, an iron club head is poor in elasticity. Particularly, in the case where a ball hitting surface of the club head which is most important in hitting a ball has less elasticity, the coefficient of restitution of the ball hitting surface is so small that it is impossible to obtain a soft ball-hitting feeling as well as a long ball-flying distance unlike a wood club.

Conventionally, as disclosed in Japanese Utility Model Unexamined Publication No. sho-61-139256, or as shown in FIG. 8 of this application, a hosel portion 1 for connection with a shaft, a sole portion 3, and a thin frame portion 7 defining the contour of a base metal body portion 5 are integrally made of a metal material such as soft iron, stainless steel, or the like. Further, as shown in FIG. 9, a filling member 11 made of fiber-reinforced resin mainly including carbon fibers is filled in a hollow portion 9 formed inside the thin frame portion 7, and the thin frame portion 7 and the filling member 11 are covered with fiber-reinforced resin 13 mainly including carbon fibers so that it is possible to improve repulsion force of the ball hitting surface and it is possible to obtain soft ball-hitting feeling in hitting a ball. In the drawing, the reference numeral 15 designates a shaft and 17 designates a face plate.

Further, an iron club head in which not only inertia moment and repulsion force are increased but buffer against impact distortion transmitted to a player at the time of impact is provided, is disclosed in Japanese Utility Model Unexamined Publication No. Sho-60-49868.

This golf club head has a configuration in which, as shown in FIGS. 10 and 11, recess portions 25 and 27 are formed respectively in the substantially central portions or face surfaces 21 and 23 opposite to each other of a base metal body 19 made of a metal material such as soft iron, stainless steel or the like, a number of fine holes 29 are formed in the bottom portions of the respective recess portions 25 and 27 so as to make the recess portions 25 and 27 have grid structures respectively, and a face body 31 and a back face body 33 made of fiber-reinforced resin or the like are mounted in the recess portions 25 and 27 respectively.

In such a conventional golf club head of this kind, however, it is general that a sole portion 3 is made heavy so that a top portion opposing to the sole portion 3 through the hollow portion 9, as shown in FIG. 8, is lighter in weight than the sole portion 3.

In such a conventional golf club head, therefore, the return of the sole portion 3 is faster than the top portion at the time of swinging so that a hit ball is apt to fly high. Accordingly, it has been difficult to hit a liner ball without being influenced by wind.

Further, also in the golf club head shown in FIG. 10, there is no positive description about the weight balance between the sole and top portions of the base metal body on the opposite sides of the concave portions 25 and 27 in the specification of the Japanese Utility Model Unexamined Publication No. Sho-60-49868. In the case where the sole portion 3 is heavier than the top portion as shown in the drawing, the return of the sole portion is faster than that of the top portion at the time of swinging so that it has been difficult to hit a liner ball.

SUMMARY OF THE INVENTION

The present invention has been attained in view of such circumstances, and an object thereof is to provide a golf club head in which vertical balance between top and sole portions of a base metal body is adjusted so that a liner ball can be hit without being influenced by wind.

In order to attain the above object, according to the present invention, the golf club head comprises: a hosel portion for connection with a shaft, and a base metal body formed integrally with the hosel portion by a metal material so as to continue to the hosel portion, the base metal body being constituted by a sole portion, a top portion and a space portion formed between the sole portion and the top portion and filled with a filling member, the sole portion and the top portion being formed so as to be substantially equal in weight to each other, the space portion being placed in a sweet-spot corresponding position so that the space portion corresponds to a sweet spot, the filling member being formed by a material smaller in specific gravity than the base metal body.

According to the present invention, the vertical balance between the sole portion and the top portion is adjusted so that a ball is hit in a condition that the return of the sole portion side does not become faster than the top portion side.

DETAILED DESCRIPTION OF PREFERRED EMBODIMENTS

Figure 1:
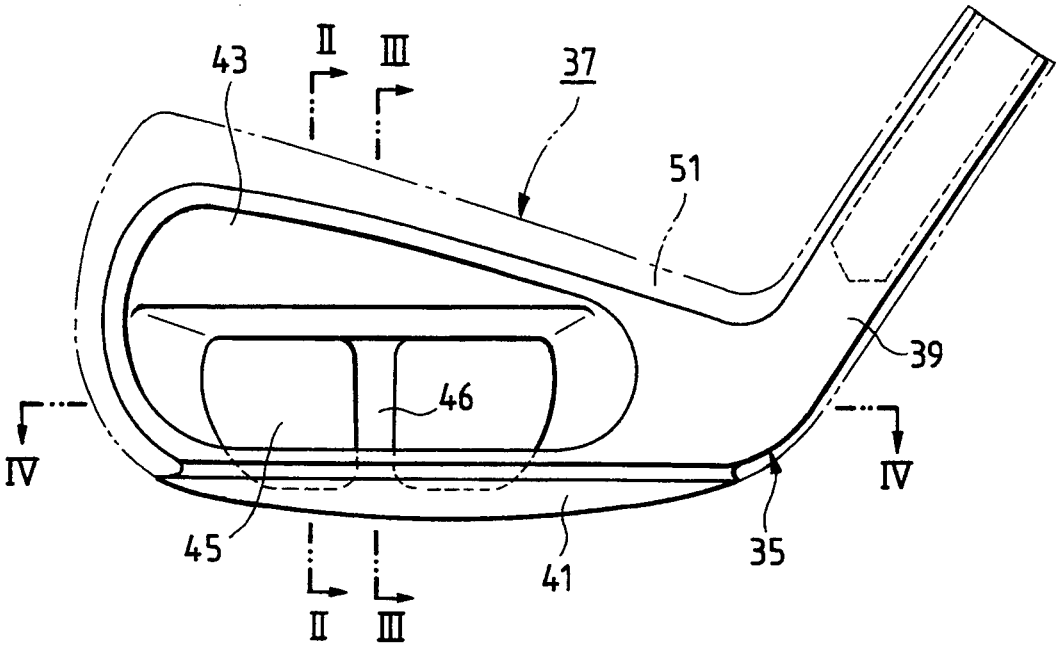
FIG. 1 is a front view of a base metal body of the golf club head according to a first embodiment of the present invention.

Referring to the drawings, embodiments of the present invention will be described in detail hereunder.

FIGS. 1 through 4 show a first embodiment of the golf club head according to the present invention. In FIG. 1, a base metal body 35 of the golf club head 37 according to this embodiment is continued to a hosel portion 39 which is to be connected to a shaft similarly to a conventional metal body, and the base metal body 35 is constituted by a sole portion 41 and a top portion 43 integrally with each other by a metal material such as soft iron, brass, stainless steel, or the like.

The top portion 43 is formed above the sole portion 41 with a space 45 formed therebetween so as to have weight substantially the same as that of the sole portion 41. The sole portion 41 and the top portion 43 extend in substantially parallel with each other from the heel side to the toe side of the base metal body 35 with a substantially same distance therebetween, and the sole portion 41 and the top portion 43 are connected to each other by a support pole 46 at the central position of the space 45 on the back side of the base metal body 35.

The space 45 formed between the sole portion 41 and the top portion 43 is placed at a sweet-spot corresponding position so as to correspond to a sweet spot (the foot of the perpendicular to the hitting surface of the golf club head from the gravity of a golf club head). The height and width of the space 45 are the same as or larger than those of a sweet area (which is a gathering of impact centers on a hitting surface around a sweet spot showing allowable ball flying performance in shots the impact centers of which come out of the sweet spot, that is, for example, a hitting surface in which the reduction of carry is not larger than 5% in comparison with the case where a ball is hit on the sweet spot) so that a ball is hit on a face portion of the golf club head 37 corresponding to the space 45. The golf club head 37 according to this embodiment is configured so that if the perpendicular passing through the sweet spot of the golf club head 37 is extended backward, the perpendicular passes through a substantially middle portion between the sole portion 41 and the top portion 43, in other words, so that the sweet spot comes to the face corresponding to the substantially middle portion between the sole portion 41 and the top portion 43.

Figure 3:
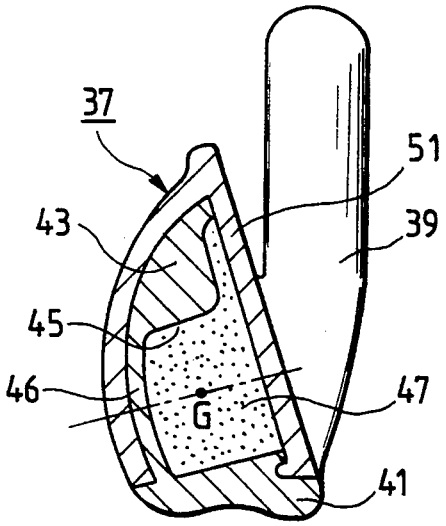
FIG. 3 is a sectional view taken on a line III—III in FIG. 1.

Accordingly, the center of gravity G of the golf club head 37 according to the present invention is positioned at the substantially middle portion between the sole portion 41 and the top portion 43 within the space 45 as shown in FIG. 3. The substantially middle portion used herein includes an exact middle portion in a vertical direction between the sole portion 41 and the top portion 43 within the space 45, and also includes a portion which is slightly further from the exact middle portion upward toward the top portion 43 since the entire weight of the golf club head 37, in some cases, includes the weight of the hosel portion 39. In addition, in such cases it is possible to position the center of gravity G at the exact middle portion by decreasing the length of the hosel portion 39 to reduce the weight thereof.

Figure 2:
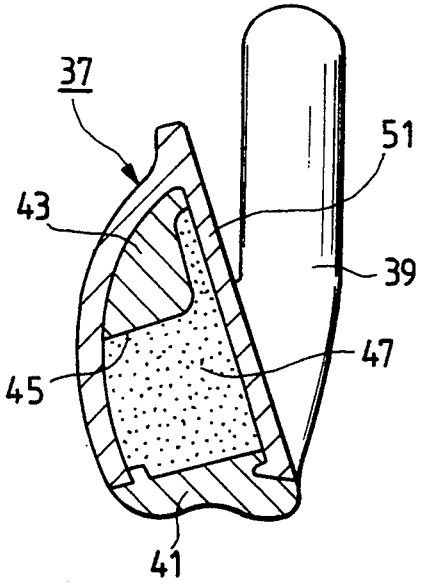
FIG. 2 is a sectional view taken on a line II—II in FIG. 1.

As shown in FIGS. 2 and 3, a filling member 47 is filled in the space 45 through injection molding, bonding, or the like.

Figure 4:
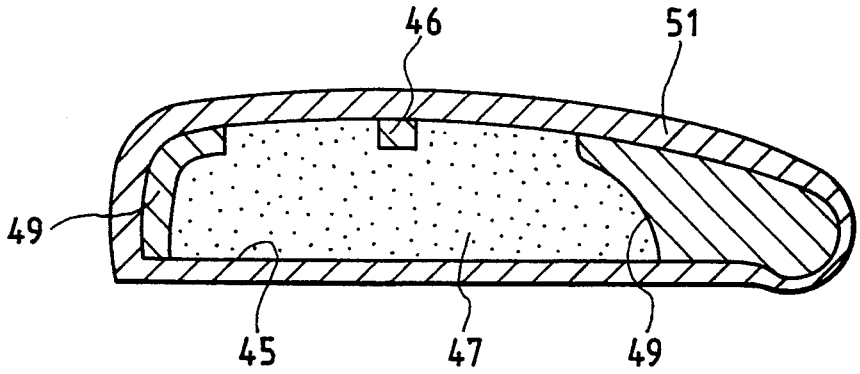
FIG. 4 is a sectional view taken on a line IV—IV in FIG. 1.

The filling member 47 is made of a material (for example, a resin material such as nylon, polypropylene, ABS resin, polyethylene terephthalate, hard vinyl chloride, or the like, or a mixture in which glass fibers, glass balloon, carbon fibers, carbon powder, other metal powder, or the like is mixed to the above resin material) which is lighter in weight than the material of the sole portion 41 and the top portion 43 of the base metal body 35 so that the filling member 47 has specific gravity not larger than 1.4. As shown in FIGS. 2 through 4, the filling member 47 is held at its outer circumference by side walls 49 on the heel side and the toe side of the base metal body 35, and by the sole portion 41, and the top portion 43.

As shown by a two-dotted chain line of FIG. 1 and by a solid line of FIG. 2, the outside of the base metal body 35 except the sole portion 41 is covered with fiber-reinforced resin 51 having specific gravity which is larger than that of the filling member 47 so as to form the golf club head 37 according to the present invention.

As described above, in the golf club head 37 according to the present invention, the sole portion 41 and the top portion 43 of the base metal body 35 are formed so as to be substantially equal in weight to each other. In the case where a ball is hit by use of a golf club having the golf club head 37 mounted thereon, the golf club head is vertically balanced so that the return on the sole portion 41 side does not become faster than that on the top portion 43 side.

According to this embodiment, therefore, a hit ball does not fly high so that it becomes easy to hit a liner ball without being influenced by wind, and the sole portion 41 and the top portion 43 are vertically balanced with each other so that stable ball-hitting can be performed.

Further, the golf club head 37 according to the present invention is configured so that a ball is hit on the face portion of the golf club head 37 corresponding to the space 45 filled with the filling member 47, the space 45 is placed at a sweet spot corresponding position so as to correspond to the sweet spot and is formed so as to have height and width which are the same as or larger than those of the sweet area. Accordingly, the repulsion force on the ball hitting surface never deteriorates in comparison with the conventional golf club head, and soft ball-hitting feeling can be obtained at the time of hitting a ball.

Figure 5:
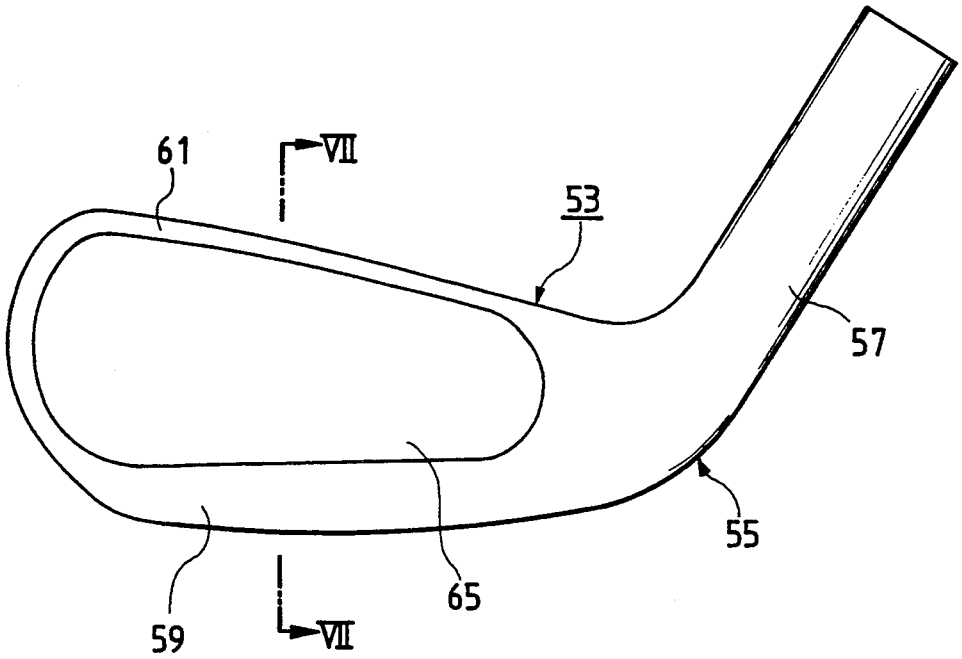
FIG. 5 is a front view of the golf club head according to a second embodiment of the present invention.
Figure 6:
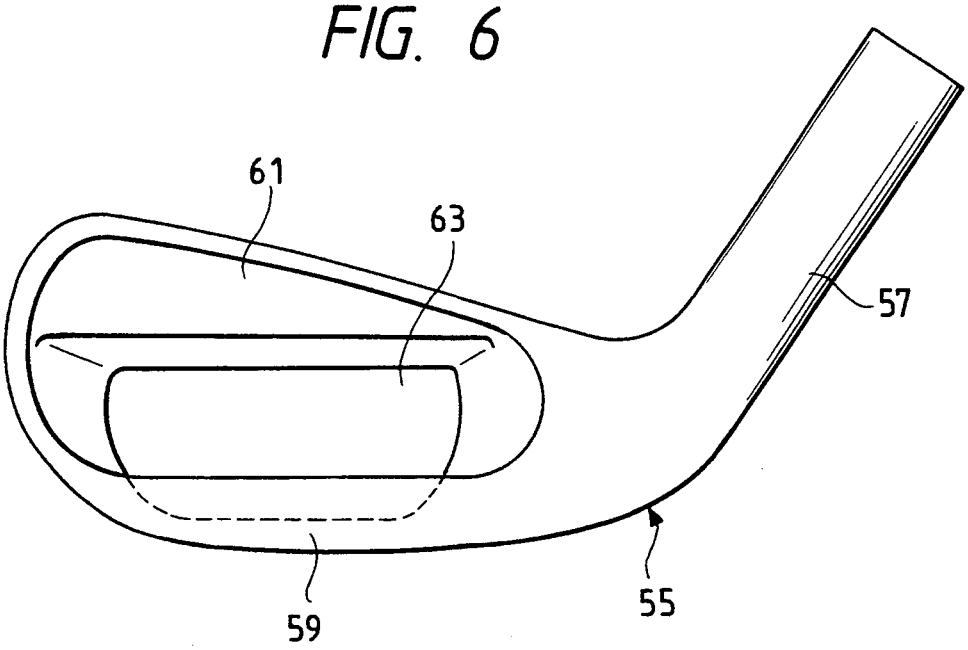
FIG. 6 is a front view of a base metal body of the golf club head according to the second embodiment of the present invention.
Figure 7:
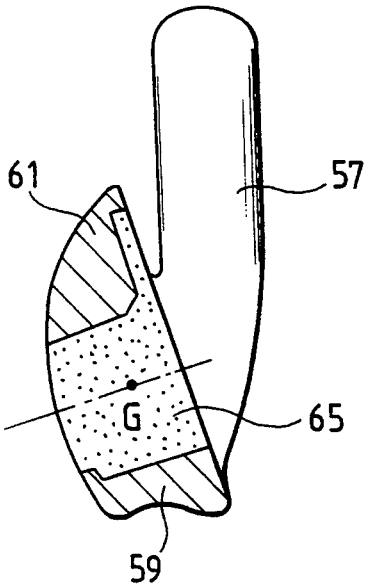
FIG. 7 is a sectional view taken on a line VII—VII in FIG. 5.
Figure 8:
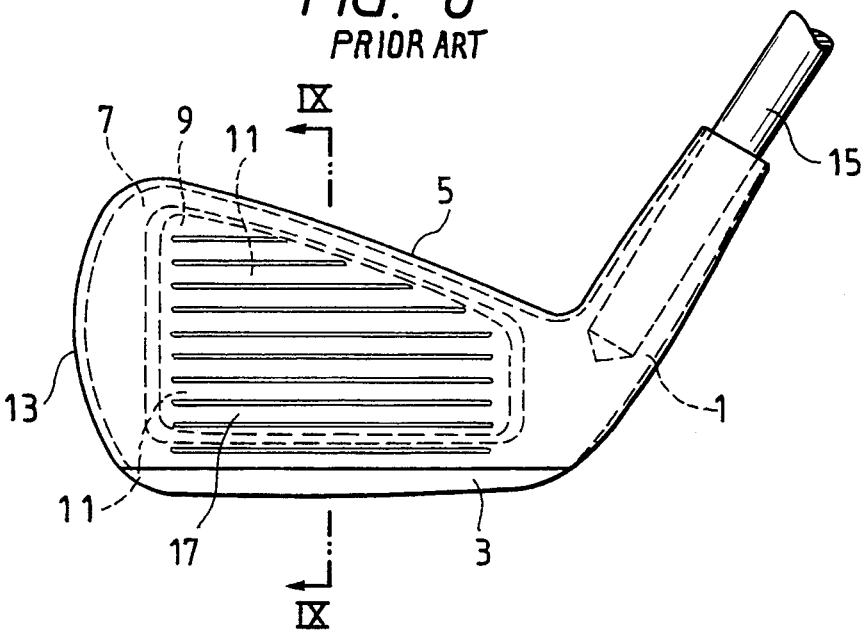
FIG. 8 PRIOR ART
FIG. 8 is a front view of a prior art golf club head.
Figure 9:
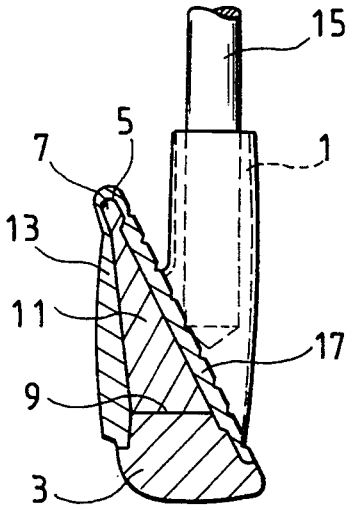
FIG. 9 PRIOR ART
FIG. 9 is a sectional view taken on a line IX—IX in FIG. 8.
Figure 10:
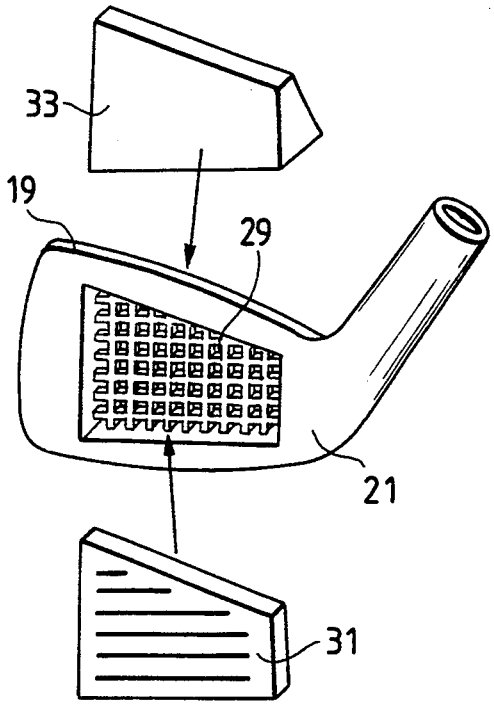
FIG. 10 PRIOR ART
FIG. 10 is an exploded perspective view of another prior art golf club head.
Figure 11:
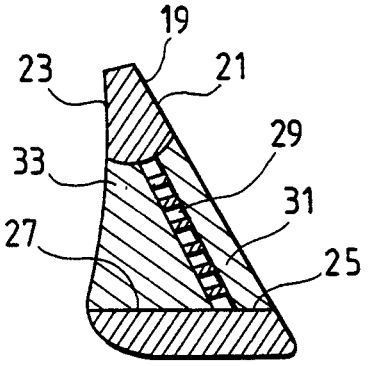
FIG. 11 PRIOR ART
FIG. 11 is a sectional view of the golf club head of FIG. 10.

FIGS. 5, 6 and 7 show a golf club head 53 according to a second embodiment of the present invention. As shown in FIG. 6, a base metal body 55 of the golf club head 53 according to this embodiment is continued to a hosel portion 57, and is constituted by a sole portion 59 and a top portion 61 integrally with each other by a metal material such as soft iron, stainless steel, or the like. The top portion 61 is formed above the sole portion 59 through a space 63 so as to have weight substantially the same as that of the sole portion 59. The sole portion 59 and the top portion 61 are provided side by side so as to extend from the heel side to the toe side of the base metal body 55 with a substantially same distance therebetween.

Further, similarly to the first embodiment described above, the space 63 formed between the sole portion 59 and the top portion 61 is placed so as to correspond to a sweet spot so that the sweet spot comes to a face corresponding to the substantially middle portion between the sole portion 59 and the top portion 61, and the height and width of the space 63 are made the same as or larger than those of a sweet area.

As shown in FIG. 7, a fitting member 65 is filled in the space 63 through injection molding, bonding, or the like.

Thus, unlike the golf club head 37 according to the first embodiment in which the outside of the base metal body 35 is covered with the fiber-reinforced resin 51, the golf club head 57 according to the second embodiment has a structure in which the outside of the base metal body 55 is not covered with fiber-reinforced resin, and the filling member 65 is a resin or resin-mixed material which is similar to the filling member 47 of the first embodiment and which has specific gravity not larger than 3. The space 63 is filled with the filling member 65 so as to form the face side and back side of the golf club head 53.

In this embodiment having such a configuration, the golf club head is vertically balanced so that the return of the sole portion 59 side is never faster than the top portion 61 side when a ball is hit by use of the golf club having the golf club head 53 mounted thereon.

In this embodiment, therefore, a liner ball can be easily hit without being influenced by wind, and a stable ball-hitting can be obtained because the sole portion 59 and the top portion 61 are vertically balanced with each other, similarly to the first embodiment.

Further, in the embodiment, a ball is hit on the filling member 65 filled in the space 63 as a face portion, the space 63 is placed at a sweet-spot corresponding position so as to correspond to a sweet spot, and the height and width of the space 63 are selected so as to be the same as or larger than those of the sweet area, so that repulsion force on the ball hitting surface never deteriorates in comparison with the conventional golf club head, and soft ball-hitting feeling can be obtained at the time of hitting a ball.

As described above, according to the present invention, it is easy to hit a liner ball without lowering the repulsion force on the ball hitting surface and the soft ball-hitting feeling, without making the ball fly high up and without being influenced by wind, and it is possible to perform stable ball-hitting because the sole portion and the top portion are vertically balanced with each other.

What is claimed is:

1. A golf club head comprising:

a one-piece base metal body including an integral hosel portion adapted to be connected to a shaft of a golf club, an integral sole portion and an integral top portion, said base metal body defining a space between said sole portion and said top portion; and a filling member filled in said space, and wherein:

said sole portion and said top portion are substantially equal in weight to each other;

the center of gravity of the golf club head is positioned at a substantially middle portion between said sole portion and said top portion within said space; and said filling member is formed of a material smaller in specific gravity than said base metal body.

2. The golf club head according to claim 1, wherein size of said space is not smaller than that of a sweet area, said sweet area being a gathering of impact centers on a hitting surface around a sweet spot in which a reduction of carry is not larger than 5% in comparison to a carry when a golf ball is hit with the sweet spot, said sweet spot being located on said hitting surface at an intersection of a perpendicular to said hitting surface passing through said center of gravity.

3. The golf club head according to claim 1, wherein a sweet spot is positioned on a hitting surface at a position corresponding to said middle position between said sole portion and said top portion, said sweet spot being located on said hitting surface at an intersection of a perpendicular to said hitting surface passing through said center of gravity.

4. The golf club head according to claim 1, wherein the specific gravity of said filling member is not greater than 3.0.

5. The golf club head according to claim 1, wherein said top portion and said sole portion extend in parallel relation to each other with a substantially constant distance formed therebetween.

6. The golf club head according to claim 1, wherein said sole portion and said top portion are connected to each other through a support pole.

7. The golf club head according to claim 6, wherein said support pole is disposed at a central position within said space.

8. The golf club head according to claim 1, wherein an outer peripheral surface of said base metal body is covered with a fiber-reinforced resin.

9. The golf club head according to claim 8, wherein said fiber-reinforced resin is larger in specific gravity than said filling member.

10. The golf club head according to claim 8, wherein the specific gravity of said fiber-reinforced resin is not greater than 1.4.

11. The golf club head according to claim 1, wherein said space extends through said base metal body.

12. The golf club head according to claim 1, wherein said space is opened to an exterior of said base metal body at least at a side thereof where a face plate is positioned.

13. A golf club head comprising:

a one-piece base metal body including:

an integral hosel portion adapted to be connected to a shaft of a golf club, an integral sole portion, an integral top portion opposite said sole portion, said base metal body defining a space between said sole portion and said top portion; and a filling member filling in said space, said filling member defining a facing surface proximate a hitting surface for hitting a golf ball, and a rear surface opposite said facing surface, said space extending through said base metal body from said facing surface to said rear surface, wherein said sole portion and said top portion are substantially equal in weight to each other;

the center of gravity of the golf club head is positioned at a substantially middle portion between said sole portion and said top portion within said space; and said filling member is formed of a material smaller in specific gravity than said base metal body.

14. The golf club head according to claim 13, wherein said facing surface, said rear surface, and an outer peripheral surface of said base metal body are covered with a fiber-reinforced resin.

* * * * *